United States Patent [19]

Suzuki et al.

[11] 4,437,440

[45] Mar. 20, 1984

[54] AUXILIARY COMBUSTION CHAMBER PREHEATING DEVICE

[75] Inventors: Shin Suzuki; Toshihiko Sato, both of Aichi, Japan

[73] Assignee: NGK Spark Plug Co., Ltd., Aichi, Japan

[21] Appl. No.: 50,410

[22] Filed: Jun. 20, 1979

[51] Int. Cl.[3] ..... F02N 17/00

[52] U.S. Cl. ..... 123/145 A; 123/145 R; 123/179 H

[58] Field of Search ..... 123/145 A, 145 R, 30 A, 123/184, 122 F, 179 H; 361/264, 266

[56] References Cited

U.S. PATENT DOCUMENTS

| | | | |
|---|---|---|---|
| 1,332,636 | 3/1920 | Romig | 123/145 A |
| 2,030,937 | 2/1936 | Reichmann | 123/145 A |
| 2,840,067 | 6/1958 | Carlson | 123/145 A |
| 3,562,590 | 2/1971 | Mitts et al. | 361/264 |
| 3,675,033 | 7/1972 | Richard et al. | 123/145 A |
| 3,749,980 | 7/1973 | Baxter | 123/145 A |
| 4,107,510 | 8/1978 | Tombs et al. | 123/145 A |

FOREIGN PATENT DOCUMENTS

| | | | |
|---|---|---|---|
| 588173 | 9/1931 | Fed. Rep. of Germany | 361/266 |
| 916367 | 7/1954 | Fed. Rep. of Germany | 123/145 A |
| 489225 | 9/1918 | France | 123/145 A |
| 1292098 | 6/1961 | France | 123/145 A |
| 534230 | 3/1941 | United Kingdom | 123/145 A |

*Primary Examiner*—Parshotam S. Lall

*Attorney, Agent, or Firm*—Sughrue, Mion, Zinn, Macpeak & Seas

[57] ABSTRACT

An auxiliary combustion chamber preheating device having a glow plug for a diesel engine with a metal shell threadedly mountable on the engine and a center electrode having a rod-like configuration. A tubular heat generating element having an opened end and a closed end is made of a nonmetalic resistance material selected from the group consisting of silicon carbide (SiC) or molybdenum disilicide ($MoSi_2$) and inserted and is connected to the metal shell at the open end thereof. An electrical connection is established for electrically connecting a lower end surface of the center electrode and an inner wall portion of the closed end portion of the heat generating element. An electrical conductive layer is formed on an outer wall portion of the heat generating element.

7 Claims, 7 Drawing Figures

AUXILIARY COMBUSTION CHAMBER PREHEATING DEVICE

BACKGROUND OF THE INVENTION

The present invention relates to a glow plug used for preheating an auxiliary combustion chamber in internal combustion engines.

There has been provided in this technology a glow plug using a nonmetallic heat generating resistance such as silicon carbide (SiC) or the like as a heat generating element. Typically, a rod-shaped heat generating element made of silicon carbide is inserted into a metallic sheath tube. Alternatively, a silicon carbide heat generating element having a U-shaped cross section is mounted on a metal shell. In the former case, due to electric insulative powders such as magnesia filled in the sheath tube, thermal conduction is prevented to thereby delay the temperature rise on an outer surface of the sheath tube. However, durability deteriorates with the complexity of the connection to the associated electrode. In the latter case, the shape of the heat generating element is complicated and difficulties of connection between the heat generating element and the metal shell are liable to occur.

Turning to the starting characteristics of diesel engines, the higher a surface temperature of a glow plug, the more easily or positively the engine can be started even at low ambient temperatures in winter, particularly when the plug is heated to the extent of 1300° C. Namely, when a surface temperature of the heat generating portion of the glow plug is low, it takes a long period of time from the initial explosion to the complete explosion so that electric current is expended without producing positive results. At high temperatures, as quick start can be smoothly accomplished.

It is, however, impossible to obtain satisfactory starting characteristics using a metallic glow plug in which a metallic heat generating element made of material such as nickel-chrome and iron-chrome are wound in a spiral manner in the metallic tube. The metallic glow plug of this construction has a low allowance temperature of at most 1100° C.

SUMMARY OF THE INVENTION

In order to overcome the above-mentioned defects, an object of the present invention is to provide a new glow plug construction satisfying the conditions for sufficient starting property.

Another object of the present invention is to provide a glow plug in which a surface temperature of the heat generating element is increased above 1100° C. to thereby improve the starting characteristics of diesel engines at a low ambient temperature.

Still another object of the present invention is to provide a glow plug in which a surface temperature rise is achieved in a short time and the connection to the metal shell is easily and positively carried out.

These and other objects of this invention are accomplished by an auxiliary combustion chamber preheating device having a glow plug for a diesel engine. The device has a metal shell threadedly mountable on the engine and a center electrode having a rod-like configuration. A tubular heat generating element having an opened end and a closed end is made of a nonmetallic resistance material selected from the group consisting of silicon carbide (SiC) or molybdenum disilicide ($MoSi_2$) that is inserted and connected to the metal shell at the open end thereof. An electrical connection is established for electrically connecting a lower end surface of the center electrode and an inner wall portion of the closed end portion of the heat generating element. An electrical conductive layer is formed on an outer wall portion of the heat generating element.

The electrical connection can be formed using carbon powders and a space defined by the center electrode and the powders within the tubular heat generating element being filled with non-oxidizing electrical insulative material selected from the group consisting of silicon nitride ($Si_3N_4$), boron nitride (BN) or aluminum nitride (AlN). Additionally, a ceramic sleeve member may be disposed on the bottom wall of the closed end of the heat generating element.

BRIEF DESCRIPTION OF THE DRAWINGS

The present invention will be described in detail in reference to the accompanying drawings in which.

DESCRIPTION OF THE PREFERRED EMBODIMENT

Figure 1B:
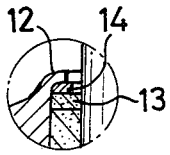
FIGS. 1 to 6 show first through sixth embodiments of glow plugs for internal combustion engines according to the present invention, respectively.
Figure 1A:
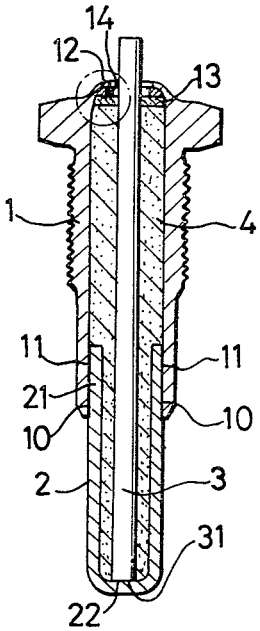

FIGS. 1A and 1B shows a first embodiment embodying the invention. Reference numeral 1 designates a metal shell of a glow plug. A heat generating tube 2 made of a nonmetallic resistance material such as silicon carbide (SiC) and molybdenum disilicide ($MoSi_2$) has an opened end 21, a closed end 22 and a hollow space therein. The opened end 21 is inserted into the metal shell as shown in FIGS. 1A and 1B. An electrode layer of silver, copper or the like, adhering to an outer wall of the opened end 21 by fusing-injection is connected to an inner wall 11 of the metal shell 1 with a brazing material 10 such as silver, copper or the like. A rod-like center electrode 3 made of metal such as tungsten, molybdenum or the like is coaxially implanted in the metal shell 1 and the heat generating tube 2. An end portion 31 of the center electrode 3 abuts directly to an inner end surface of the closed end 22 of the heat generating tube 2.

Electrical insulative ceramic powders 4 such as magnesia and alumina fill a hollow space defined by the metal shell 1, the heat generating tube 2 and the center electrode. The ceramic powders 4 are stably maintained therein by caulking a metal packing 14 and an electric insulative annular plug 13 made, for example, of silicon rubber at a top end portion 12 of the metal shell 1.

The glow plug thus constructed is mounted in an auxiliary combustion chamber of an internal combustion engine so that an electric current flows thereto through the metal shell forming an outer electrode. Since the heat generating tube 2 is directly exposed, the outer wall of the heat generating tube 2 can be rapidly heated by the heat generation in the heat generating tube 2, thereby enhancing the efficiency of heating of the auxiliary combustion chamber. Furthermore, since the heat generating tube 2 is formed into a tubular shape having the closed end, the construction is relatively simple, and the connection to the metal shell is facilitated by the brazing or the like.

Figure 2:
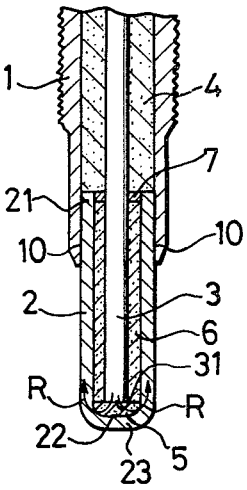

FIG. 2 shows a second embodiment of a glow plug according to the present invention. In the following embodiments, like members or parts will be used with the same reference numerals as used in FIGS. 1A and 1B. FIG. 2 shows a second preferred embodiment of a glow plug in which center electrode 3 is inserted into a heat generating tube 2 while the end surface 31 of the center electrode 3 is separated from the inner surface of the closed end 22 of the heat generating tube 2. The inner closed portion 22 of the heat generating tube 2 is filled with carbon powders 5. Non-oxidizing electric insulative powders 6, such as silicon nitride ($Si_3N_4$), boron nitride (BN), aluminum nitride (AlN) or the like are disposed adjacent to the carbon powders 5. The opened end 21 of the heat generating tube is sealed by a seal member 7 made of glass or the like.

The glow plug thus constructed is used while an electric current flows between the center electrode 3 and the metal shell 1. The carbon powders 5 serve to ensure the electric connection between the heat generating tube 2 and the center electrode 3 and to absorb the heat expansion difference therebetween due to suitable fluidity thereof to thereby prevent damage of the heat generating tube 2. The electric insulative powders such as $Si_3N_4$, BN or AlN react with oxygen contained in the air enclosed in the heat generating tube to form silicon dioxide. Therefore, the insulative powder 6 serves to consume the free oxygen in the heat generating tube and has a reduction effect to prevent the oxidation of the center electrode and the carbon powder to thereby also prevent the increase of the resistance of the glow plug.

Figure 3:
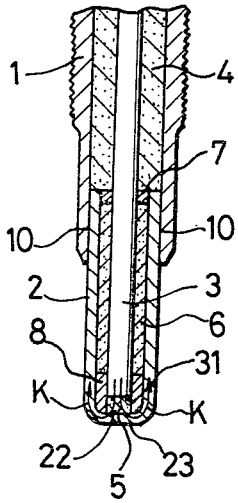

FIG. 3 shows a third embodiment of the present invention. In the same manner as described in the above, the center electrode is inserted into the closed end portion of the heat generating tube but separated from the closed end 22 of the heat generating tube. In FIG. 3, a sleeve 8 made of silicon nitride is provided so as to partially encircle the end portion 31 of the center electrode 3. The outer end of the sleeve 8 abuts with the closed inner end portion 22 of the heat generating tube 2. Then, the inner hollow space of the sleeve 8 is filled with carbon powders 5. In this embodiment, an electric current flows through the end portion 23 of the heat generating tube 2 in the directions shown by arrows K. Accordingly, the end portion 23 can contribute to heating more effectively. In contrast, in FIG. 2, an electric current flows as shown by arrows R. As a result, the heat generation at the end portion 23 in FIG. 2 occurs somewhat slower than that in FIG. 3.

A repetitive electric current heating experiment was carried out, ten-thousand cycles, using the glow plug in FIG. 2 according to the present invention, in which the surface temperature of the heat generating tube is heated to 1000° C. from room temperature. As a result, no increment of the resistance value occurred and no damage of the heat generating tube occurred.

Figure 4:
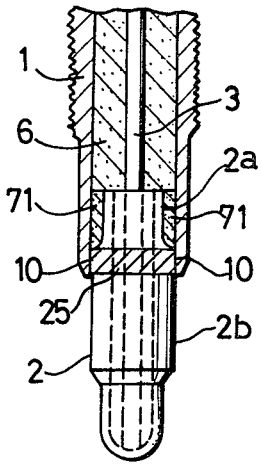

In FIG. 4, element 2 is a heat generating tube. A side portion of the open end of the heat generating tube 2 is designated by *2a*. An electrical conductive layer 25 is made of alloy or pure metal, such as silver, copper or the like and is stuck to an end portion of a large diameter portion *2b* of the heat generating tube 2 by fusing or baking. The electrical conductive layer 35 is connected to the inner wall of the metal shell 1 by brazing material such as silver, copper or the like thereby allowing an electric current to flow through the heat generating tube 2 and the metal shell 1. A heat reistance adhesive agent 71 fills an annular space defined by the side portion *2a* of the open end portion of the heat generating tube 2. The metal shell 1, made of material having a high heat insulative performance such as ceramic bond or the like, serves to secure the heat generating tube 2 and the metal shell 1 and at the same time to seal them. In this embodiment, the overall surface of the electrical conductive layer 25 is remarkably reduced by the specific construction as described above.

When an electric current flows between the center electrode 3 and the metal shell 1 in the above described construction, heat conduction of the heat generating tube 2 from the part filled with the adhesive agent 71 to the metal shell 1 is prevented. The rate of escape of the heat to the engine body is reduced.

Figure 5:
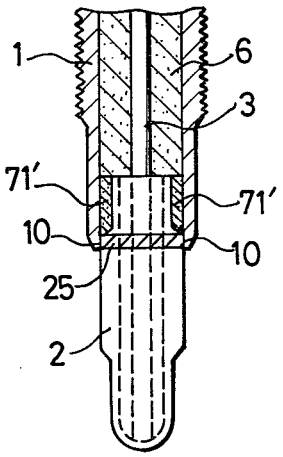

FIG. 5 shows a modification to the present invention, wherein a heat insulative layer 71' is made by ceramic-coating the annular space defined by the upper portion of the heat generating tube 2 and the metal shell 1.

Figure 6:
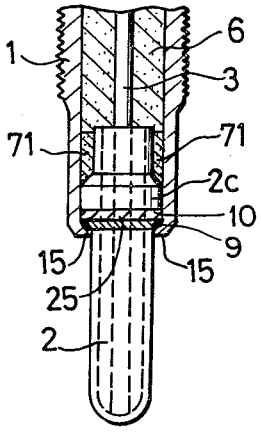

FIG. 6 shows another modification to the present invention, wherein an expanded portion *2c* is formed on the metal shell covered portion of the heat generating tube 2, and an electric conductive layer 25 is applied to the lower portion thereof. A packing member 9 such as copper, silver or the like is disposed between the lower end portion 15 of the metal shell 1 and the heat generating tube 2.

In the preceding embodiments, a thermocouple is formed of silicon carbide (SiC) of heat generating tube 2 of the glow plug and nickel, tungsten or molybdenum of the center electrode 3 due to their thermal electromotive force. The output voltage is at 90 to 110 mV when a temperature at the closed end portion 23 of the heat generating tube 2 is at 1000° C. Such an output voltage is approximately twice of that of a chromel-alumel thermocouple, which is in the order of 41.31 mV/1000° C. For this reason, an operation in which another thin thermocouple is inserted into the glow plug can be dispensed with. At the same time, a disconnection of the thermocouple does not occur because the center electrode and the heat generating tube are sufficiently thick.

Figure 7:
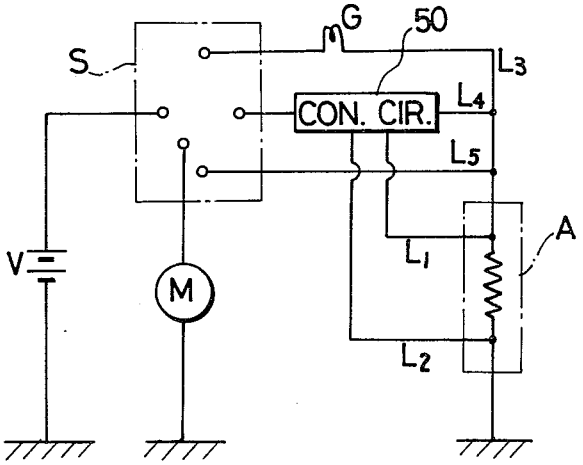
FIG. 7 shows an electrical circuit for controlling the preheating the auxiliary combustion chambers using the glow plugs, according to the present invention.

FIG. 7 shows a preheating circuit used in the preheating device accordinfg to the present invention, wherein V designates a battery or electric source, M a motor, S a switch, G a signal lamp and 50 an electric flow control circuit forming the present invention together with the glow plug A. The control circuit is composed of a relay circuit and relay elements having a switching operation such as a lead switch opened or closed by the output signal of the thermocouple formed of the center electrode 3 and the heat generating tube 2. The center electrode 3 is connected to the electric flow control circuit 50 by line $L_1$. The heat generating tube 2 is connected to the flow control circuit 50 by line $L_2$. Switch S is connected through the signal lamp G to the glow plug A by line $L_3$. Also, the switch S is connected through the control circuit 50 to the glow plug A by line $L_4$. Further, the switch S is connected directly to the glow plug A by line $L_5$ without the signal lamp G when the starter motor M is driven.

In starting of the diesel engine, the starter line $L_3$ is coupled to the battery V during a time period of 10 to 30 seconds to thereby preheat the auxiliary combustion chamber. Next, the starter motor M and the circuit $L_5$ are connected to the battery V to flow an electric current through the glow plug and at the same time, the engine is started by the motor M. After the engine is started, the above described switching-in connections are released, and the circuit $L_4$ is coupled to the battery V, and while the engine is running, such a state is maintained. In this condition, in case that non-aligned combustion occurs and the temperature of the combustion chamber is reduced, for example, when the engine is driven in an engine idle condition just after starting or when in cold country a low load engine running condition is maintained during a long time period, the output voltage of the thermocouple formed of the center electrode 3 and the heat generating tube 2 is small. The control circuit 50 closes the electric line $L_4$ to thereby allow an electric current to flow through the glow plug A and to thereby heat the preheating chamber without non-aligned combustion. On the other hand, when the combustion chamber temperature is high during middle or high speed engine running conditions, that is, at more than 500° C., the output voltage of the thermocouple is high and control circuit 50 opens the electric line $L_4$ to thereby prevent the unnecessary consumption of the battery V.

It is apparent that modifications to this invention can be made without departing from the scope thereof.

We claim:

1. An auxiliary combustion chamber preheating device having a glow plug for a diesel engine, comprising:

a metal shell threadedly mountable on the engine;

a center electrode having a rod-like configuration;

a tubular heat generating element having an open end and a closed end, said element made of nonmetallic resistance material and inserted into and connected to the metal shell at the open end thereof;

electrical connecting means for electrically connecting a lower end surface of the center electrode and an inner wall portion of the closed end portion of the heat generating element;

an electrical conductive layer on an outer wall portion of the heat generating element contacting said metal shell;

said electrical connecting means includes carbon powders and a space defined by the center electrode and said connecting means within the tubular heat generating element is filled with non-oxidizing electrical insulative material selected from the group consisting of silicon nitride ($Si_3N_4$), boron nitride (BN) or aluminum nitride (AlN); and said electrical connecting means further includes a ceramic sleeve member disposed on the bottom wall of the closed end of the heat generating element.

2. An auxiliary combustion chamber preheating device having a glow plug for a diesel engine, comprising:

a metal shell threadedly mountable on the engine;

a center electrode having a rod-like configuration;

a tubular heat generating element having an open end and a closed end, said element made of nonmetalic resistance material and inserted into and connected to the metal shell at the open end thereof;

electrical connecting means for electrically connecting a lower end surface of the center electrode and an inner wall portion of the closed end portion of the heat generating element;

an electrical conductive layer on an outer wall portion of the heat generating element contacting said metal shell; and wherein said tubular heat generating element has a large-diameter portion in an intermediate portion, said large-diameter portion partially inserted into the metal shell, and an annular space defined between the open end portion of said heat generating element and the metal shell filled with a heat insulative adhesive agent to thereby ensure the sealability therebetween.

3. An auxiliary combustion chamber preheating device having a glow plug for a diesel engine, comprising:

a metal shell threadedly mountable on the engine;

a center electrode having a rod-like configuration;

a tubular heat generating element having an open end and a closed end, said element made of nonmetallic resistance material and inserted into and connected to the metal shell at the open end thereof;

electrical connecting means for electrically connecting a lower end surface of the center electrode and an inner wall portion of the closed end portion of the heat generating element;

an electrical conductive layer on an outer wall portion of the heat generating element contacting said metal shell, said tubular heat generating element having a large-diameter portion in an intermediate portion, said large-diameter portion partially inserted into the metal shell; and an annular space defined between the opened end portion of said heat generating element and the metal shell filled with a ceramic coating layer to thereby ensure the sealability therebetween.

4. An auxiliary combustion chamber preheating device having a glow plug for diesel engine, comprising:

a metal shell threadedly mountable on the engine;

a center electrode having a rod-like configuration;

a tubular heating generating element having an open end and a closed end, said element made of nonmetallic resistance material and inserted into and connected to the metal shell at the open end thereof;

electrical connecting means for electrically connecting a lower end surface of the center electrode and an inner wall portion of the closed end portion of the heat generating element;

an electrical conductive layer on an outer wall portion of the heat generating element contacting said metal shell, tubular heat generating element having a large-diameter portion in an intermediate portion and fully inserted into the metal shell, an upper annular space defined between the opened end portion of said heat generating element and the metal shell filled with a heat insulative adhesive agent; and a packing member made of an electrical conductive material being fixedly disposed in a lower annular space defined therebetween to thereby ensure the sealability therebetween.

5. An auxiliary combustion chamber preheating drive for a diesel engine as defined in claims 1, 2, 3 or 4, wherein said center electrode and heat generating element coupled to said metal shell form a thermocouple, further comprising a battery, and a control circuit responsive to the output of said thermocouple to selectively couple said battery to said preheating device to heat said auxiliary combustion chamber.

6. A device as defined in claims 1, 2, 3 or 4, wherein said nonmetallic resistance material is selected from the group consisting of silicon carbide and molybdenum disilicide.

7. A device as defined in claims 2, 3 or 4, wherein said electrical connecting means includes carbon powders and a space defined by the center electrode and said connecting means within the tubular heat generating element is filled with non-oxidizing electrical insulative material selected from the group consisting of silicon nitride ($Si_3N_4$), boron nitride (BN) or aluminum nitride (AlN).

* * * * *